US005524590A

United States Patent [19]

Jung

[11] Patent Number: 5,524,590

[45] Date of Patent: Jun. 11, 1996

[54] EFFORT LINEARIZATION DEVICE OF ACCELERATOR PEDAL

[75] Inventor: Jae-Hwa Jung, Ulsan, Rep. of Korea

[73] Assignee: Hyundai Motor Co., Ltd., Seoul, Rep. of Korea

[21] Appl. No.: 409,402

[22] Filed: Mar. 24, 1995

[30] Foreign Application Priority Data

Mar. 30, 1994 [KR] Rep. of Korea ..... 94-6462

[51] Int. Cl.[6] ..... F02D 11/04

[52] U.S. Cl. ..... 123/400

[58] Field of Search ..... 123/400, 403; 74/513; 261/65

[56] References Cited

U.S. PATENT DOCUMENTS 4,411,845 10/1983 Tanahashi et al. ..... 123/400
5,078,111 1/1992 McCann ..... 123/400

FOREIGN PATENT DOCUMENTS 58-77133 5/1983 Japan ..... 123/400

*Primary Examiner*—Andrew M. Dolinar
*Attorney, Agent, or Firm*—Birch, Stewart, Kolasch & Birch

[57] ABSTRACT

An effort linearization device for an accelerator pedal, includes a throttle body, a throttle valve arm rotatably connected to said throttle body, said throttle valve arm being provided at one end thereof with a roller means, a guide arm rotatably connected to said throttle body and provided with a guide slot which extends along said guide arm, said roller means extending into said guide slot, a first return spring operatively connected to the throttle valve arm and biased against the rotation of said arm, a second return spring operatively connected to the guide arm and biased against the rotation of said arm, and means for rotating said throttle valve arm against the bias of said first spring which in turn causes the roller means to traverse said guide slot, causing the guide arm to rotate against the bias of said second spring, whereby the operation of the accelerator pedal functions in a controlled manner through both acceleration and deceleration.

7 Claims, 2 Drawing Sheets

EFFORT LINEARIZATION DEVICE OF ACCELERATOR PEDAL

BACKGROUND OF THE INVENTION

1. Field of the Invention

The present invention is directed to an improved throttle system for a vehicle. More particularly, the present invention relates to an improved throttle system whereby the operation of the accelerator pedal is controlled from the beginning to the end of the acceleration procedure and also through deceleration, in a smooth and effective manner.

2. Description of Related Art

Several types of effort devices for an accelerator pedal are known in the art. The accelerator pedal of an automobile is provided with a throttle valve disposed on a throttle body as its source of operational power. That is, when a user, driver pushes on the accelerator pedal, the throttle valve is open and when the driver releases the accelerator pedal, the throttle valve is closed by the force of a return spring associated with the throttle body.

FIG. 6 shows a front elevational view of a conventional throttle valve arm 52. Such a conventional throttle valve arm 52 includes a throttle valve shaft 53 and a return spring 54 wound around the throttle valve shaft for biasing against the rotating power of the throttle valve arm as it is pulled by an accelerator cable 51. At this time, the operational power of the accelerator pedal is gradually increased by the force power of the return spring 54 of the throttle valve shaft 53 and another return spring associated with the accelerator pedal. However, since the gradient of the operational power of the accelerator pedal is very low, the driver does not have a comfortable feeling and the conventional device does not eliminate several abnormal situations, such as kick back of the automobile.

As shown in FIG. 7, a conventional device shows a field disposed between two dotted lines whereas a reasonable, proper usage of the new device shows a field disposed between the two solid lines, noted with cross hatching. The conventional device illustrates that the operational power of a beginning stroke is high, however that of the last stroke, such as over 50% of the stroke is low.

Accordingly, when the driver pushes the accelerator pedal in a beginning stage, the driver needs too much power and afterwards the driver does not need very much power. In other words, in a beginning stage, the rotational speed of an automobile engine is increased by strong power and after then, the automobile engine is increased by weak power in a last stage.

Thus, in such a conventional device, the driver has a bad operational feeling and in addition, when the operation changes suddenly, the automobile can generate extreme increase in speed, extreme reduction in speed, surplus load, etc. so that air and fuel supplied to the carburetor are either insufficient or in excess. Therefore the automobile operates abnormally such as by kicking back, and the like.

SUMMARY OF THE INVENTION

Accordingly, it is an object of the present invention to provide an effort linearization device for an accelerator pedal, which eliminates the above problems encountered in conventional throttle systems.

Another object of the present invention is to provide an improved throttle system including a throttle valve arm and a guide arm which are operatively connected together by a roller which traverses a predetermined path provided by the guide arm. Both the throttle valve arm and the guide arm are mounted on shafts which are provided with return springs whereby the accelerator pedal operation is gradually increased from the beginning of the stroke to the end of the last stroke.

A further object of the present invention is to provide an improved throttle system which is simple in structure, inexpensive to manufacture, durable in use, and comfortable in the operational power of the accelerator pedal.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
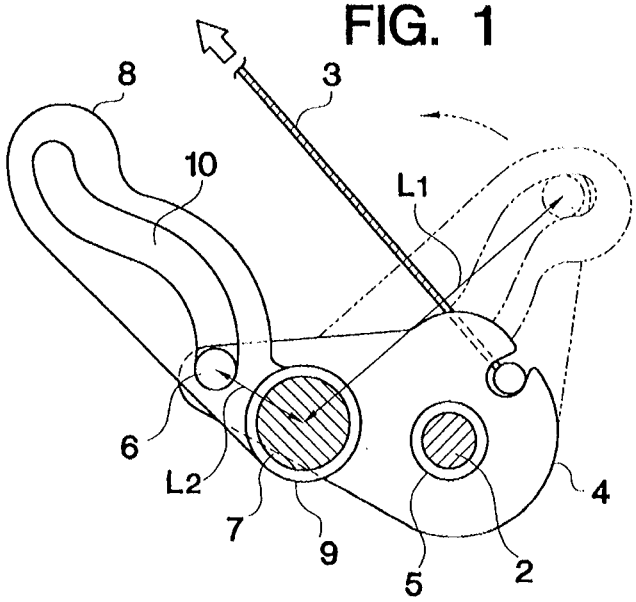
FIG. 1 is a front elevational view of an effort linearization device for an accelerator pedal according to the present invention showing the operation thereof in the completion of the stroke.
Figure 2:
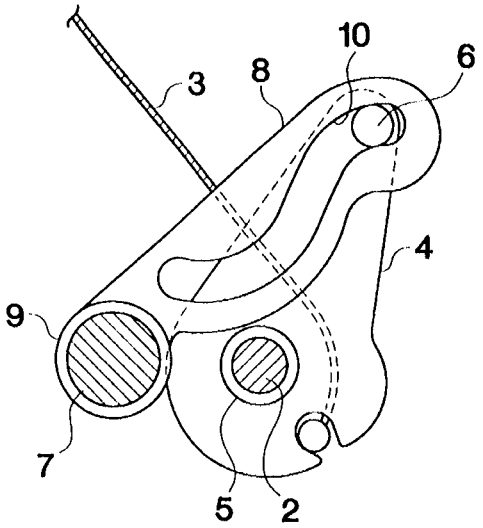
FIG. 2 is a front elevational view of the effort linearization device for an accelerator pedal according to the present invention showing the operation thereof in the initiation of the stroke.
Figure 3:
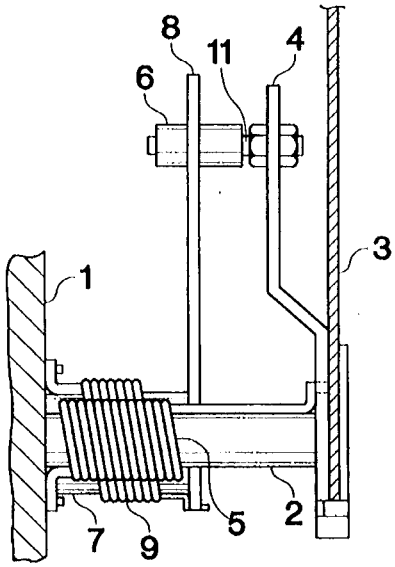
FIG. 3 is a side elevational view of the effort linearization device for an accelerator pedal according to the present invention.

Referring now in detail to the drawings for the purpose of illustrating the preferred embodiments of the present invention, the effort linearization device for an accelerator pedal as shown in FIGS. 1, 2, and 3, comprises a throttle valve arm 4, and a throttle valve shaft 2 disposed at a center portion of the throttle valve arm 4 and extending from a throttle body 1 (FIG. 3). A guide arm 8 is disposed between the throttle valve arm 4 and the throttle body 1, and a guide arm shaft 7 is attached to the guide arm 8 and also to the throttle body 1.

The throttle valve arm 4 contains a roller shaft 11 fixed to a roller 6 which is adapted to travel within a serpentine guide slot 10 of the guide arm 8. The throttle valve shaft 2 is provided with a return spring 5 wound around the valve shaft and disposed between the throttle valve arm 4 and the throttle body 1 (FIG. 3). Therefore, when an accelerator pedal (not shown) is pressed by the vehicle user whereby the accelerator cable 3 pulls the throttle arm 4, the throttle arm 4 rotates in a counterclockwise direction (FIG. 1). However, on the contrary, when the accelerator pedal is released, the throttle arm 4 returns to its original position (FIG. 2).

The guide arm shaft 7 is also provided with a return spring 9 wound around the guide arm shaft 7 and disposed between the guide arm 8 and the throttle body 1 (FIG. 3). Accordingly, the guide arm 8 operates in the same direction as the throttle valve arm 4. For example, when the accelerator pedal is released, the guide arm 8 moves together with the throttle valve arm 4 from the extended position shown in FIG. 1 to the folded position shown in FIG. 2.

When the guide arm 8 moves from its folded position (FIG. 2) together with the throttle valve arm 4, the roller 6 of the guide arm 8 smoothly traverses the serpentine guide slot 10 having an S-shaped configuration. At this time, while the roller 6 is smoothly moving along the guide slot 10, any kind of sudden change in effort created by the pushing of the accelerator pedal against the force of the return spring 5 of the throttle valve arm 4 can be eliminated and/or modulated toward linearization. The force of the return spring 9 of the guide arm 8 adds to the force of the return spring 5 of the throttle valve arm 4 and furthermore, a return spring (not shown) of the accelerator pedal can change the moving load.

As mentioned above, the effort linearization device according to the present invention shown in FIG. 2 shows the beginning state thereof. At this time, when the user presses the accelerator pedal, the accelerator cable 3 is pulled in the direction indicated by the arrow as shown in FIG. 2. Therefore, the throttle valve arm 4 rotates in the counterclockwise direction and simultaneously, the roller 6 moves from an upper position (FIG. 2) to a lower position (FIG. 1) along the S-shaped guide slot 10. That is, to a last stage of the effort linearization device of the accelerator pedal of the present invention.

Figure 4:
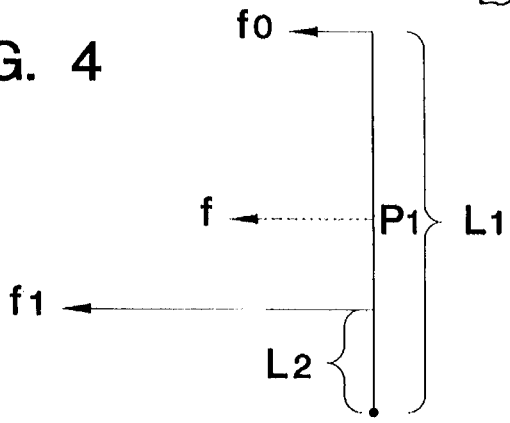
FIG. 4 graphically shows the force delivered to the accelerator pedal by the effort linearization device according to the present invention compared with that of the conventional device.
Figure 7:
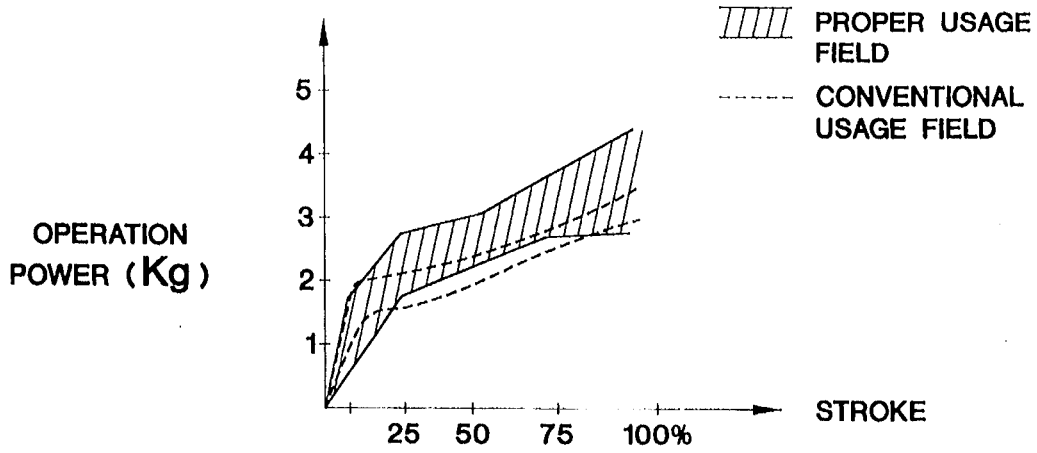
FIG. 7 CONVENTIONAL ART
FIG. 7 graphically shows the operation power and stroke for a conventional device compared with that of an ideal device.

As shown in FIG. 1, the distance from the guide arm shaft 7 to the roller 6 shows $L_1$ in a first stroke of the beginning state and $L_2$ in a last stroke of the last state of the effort linearizationing device according to the present invention. At this time, the force power delivered to the accelerator pedal is shown in FIG. 4. Letter f is the force power of a conventional throttle valve arm 52 (FIG. 7), which is delivered to the accelerator pedal. However, in the device of the present invention, $f_0$ is the force power in the beginning stroke and is one-half the power of that of the conventional device ($f_0$=2f). By pushing the accelerator pedal continuously, $f_1$ is the force operational power which is gradually increased and finally shows $f_1$ which is two times f ($f_1$=2f).

Figure 5:
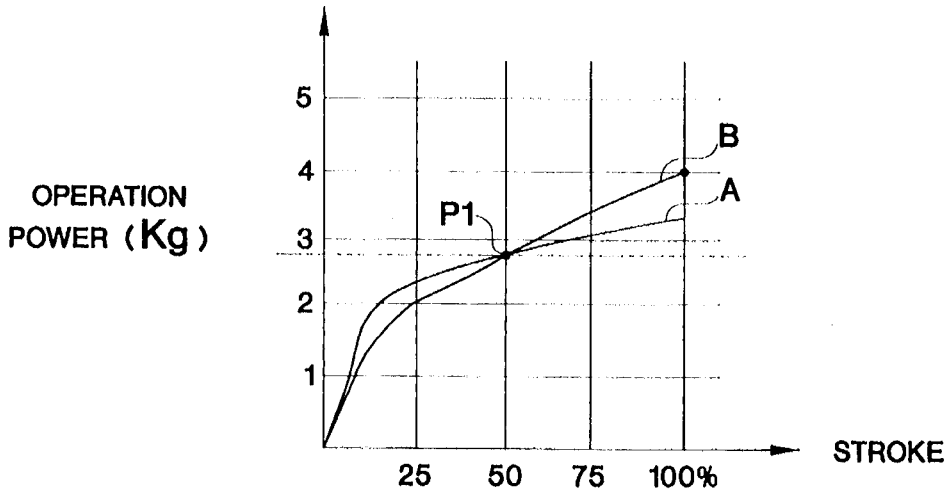
FIG. 5 graphically shows the effect of the effort linearization device on the operation power and stroke of an accelerator pedal according to the present invention.
Figure 6:
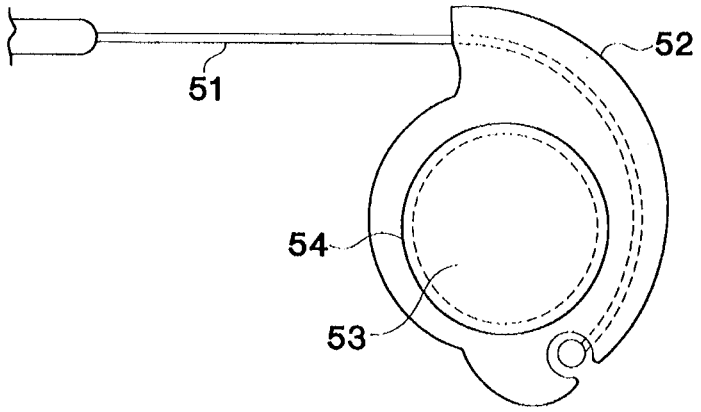
FIG. 6 CONVENTIONAL ART
FIG. 6 is a front elevational view of a throttle valve arm of a conventional device.

FIG. 5 shows a changing curve wherein A represents the state of the conventional device and B represents the state of the device of the present invention. The operational power of the device of the present invention is lower than that of the conventional device until a point $P_1$ which is a crossing point of the operation power of the conventional device and the device of the present invention. However, the operation power of the device according to the present invention is gradually increased.

Accordingly, when the user pushes the accelerator pedal, the user needs some operational power. However, after the beginning stroke, the operational power is gradually increased by the linearization of the accelerator pedal so that the user, driver feels a very comfortable operational power. In addition, even if the driver pushes the accelerator pedal suddenly or releases the accelerator pedal suddenly, the air and fuel is not suddenly supplied to the carburetor or cut off to the carburetor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An effort linearization device for an accelerator pedal, which comprises:

a throttle body, a throttle valve arm rotatably connected to said throttle body, said throttle valve arm being provided at one end thereof with a roller means, a guide arm rotatably connected to said throttle body and provided with a guide slot which extends along said guide arm, said roller means extending into said guide slot, a first return spring operatively connected to the throttle valve arm and biased against the rotation of said arm, a second return spring operatively connected to the guide arm and biased against the rotation of said arm, and means for rotating said throttle valve arm in response to the operation of the accelerator pedal against the bias of said first spring which in turn causes the roller means to traverse said guide slot, causing the guide arm to rotate against the bias of said second spring.

2. The effort linearization device of claim 1 wherein the throttle valve arm is connected to said throttle body by a throttle valve shaft.

3. The effort linearization device of claim 2 wherein the guide arm is connected to said throttle body by a guide arm shaft.

4. The effort linearization device of claim 3 wherein the first and second return springs are wound around said throttle valve shaft and said guide arm shaft, respectively.

5. The effort linearization device of claim 1 wherein said roller is connected to said throttle valve arm by a roller shaft.

6. The effort linearization device of claim 1 wherein said means for rotating said valve comprises an accelerator cable operatively connected to the accelerator pedal.

7. The effort linearization device of claim 1 wherein said guide slot has a serpentine configuration.

* * * * *